US009511915B1

(12) United States Patent
Zigah

(10) Patent No.: US 9,511,915 B1
(45) Date of Patent: Dec. 6, 2016

(54) CONFORMABLE PLIABLE PRODUCE STORAGE INSERT

(71) Applicant: Charlene M. Zigah, Potomac, MD (US)

(72) Inventor: Charlene M. Zigah, Potomac, MD (US)

( * ) Notice: Subject to any disclaimer, the term of this patent is extended or adjusted under 35 U.S.C. 154(b) by 18 days.

(21) Appl. No.: 14/669,448

(22) Filed: Mar. 26, 2015

(51) Int. Cl.

| | |
|---|---|
| ***B65D 81/02*** | (2006.01) |
| ***B65D 85/00*** | (2006.01) |
| ***B65D 1/38*** | (2006.01) |
| ***B65D 6/08*** | (2006.01) |
| ***B65D 65/06*** | (2006.01) |
| ***B65D 85/34*** | (2006.01) |
| ***B65B 3/04*** | (2006.01) |

(52) U.S. Cl.
CPC ..... *B65D 65/44* (2013.01); *B65B 3/04* (2013.01); *B65D 1/38* (2013.01); *B65D 9/10* (2013.01); *B65D 65/06* (2013.01); *B65D 85/34* (2013.01); *B65D 2565/388* (2013.01)

(58) Field of Classification Search
CPC ..... B65D 65/06; B65D 85/34; B65D 65/44; B65D 65/04; B65D 3/04; B65D 3/08; B65D 1/38; B65D 9/10; B65D 2565/388
USPC ... 206/541, 521.1, 522, 523, 594; 217/3 FC, 217/3 R; 220/9.4, 495.01, 495.03, 495.06, 6, 220/4.28; 229/87.02, 87.08
See application file for complete search history.

(56) References Cited

U.S. PATENT DOCUMENTS

| | | | | |
|---|---|---|---|---|
| 84,207 A | | 11/1868 | Moore | |
| 302,116 A | | 7/1884 | De Winter | |
| D92,044 S | | 4/1934 | Snyder | |
| RE19,168 E | | 5/1934 | Steele | |
| 2,143,662 A | * | 1/1939 | Schwarz | B65D 25/18 217/3 FC |
| 2,439,276 A | | 4/1948 | Thiele | |
| 3,024,935 A | * | 3/1962 | Vinick | B65D 65/40 206/523 |

(Continued)

FOREIGN PATENT DOCUMENTS

| | | |
|---|---|---|
| GB | 2038387 | 4/1994 |

OTHER PUBLICATIONS

Vintage Linen Madiera Embroidery Basket Liner_Announced Sep. 12, 2015 [online], Available from Internet URL: https://www.rubylane.com/item/200934-RL-62134/vintage-Linen-Madiera-Embroidery-H.

(Continued)

*Primary Examiner* — Jacob K Ackun
*Assistant Examiner* — Rafael Ortiz
(74) *Attorney, Agent, or Firm* — Lieberman & Brandsdorfer, LLC

(57) ABSTRACT

The invention is a conformable pliable storage insert device configured for placement within a basket, and corresponding storage system and method of storing and transporting. The insert device comprises an overall planar and circular configuration defining a planar circular central base having a circumscribing arcuate edge in continuity thereby defining the circular central base, and a plurality of separate planar extensions radially extending distally relative to the base in adjacent circumscribing series, each of the extensions having a pair of arcuate side edges, a proximal edge and a distal edge. The extensions are independently attached to a corresponding arcuate edge portion of the base, and the proximal edge of each planar extension is flexibly attached to the circular central base edge through a hinge panel such that a portion of each arcuate side edge of the extension is structured to overlap the arcuate side edge of an adjacent extension.

18 Claims, 8 Drawing Sheets

(56) References Cited

U.S. PATENT DOCUMENTS

| | | | | |
|---|---|---|---|---|
| D224,838 | S | 9/1972 | Douglas | |
| D228,338 | S | 9/1973 | Wilson | |
| 3,869,727 | A * | 3/1975 | Hartman | A42B 1/201 2/175.1 |
| 3,910,328 | A * | 10/1975 | Marcoux | B65D 23/08 215/12.1 |
| 4,216,256 | A | 8/1980 | Lindner | |
| D269,321 | S | 6/1983 | Zannini | |
| D272,188 | S | 1/1984 | Sneider | |
| 5,060,801 | A * | 10/1991 | Vilas-Boas | B65D 81/107 206/503 |
| 5,100,016 | A * | 3/1992 | Wischusen, III | B65D 5/248 229/103.11 |
| 5,111,613 | A | 5/1992 | Straeter et al. | |
| D345,422 | S | 3/1994 | Spence, Jr. | |
| 5,310,077 | A | 5/1994 | McDermitt et al. | |
| 5,706,969 | A * | 1/1998 | Yamada | A47J 41/0072 206/522 |
| 5,819,942 | A * | 10/1998 | Sadow | A45C 13/021 206/522 |
| 6,050,439 | A | 4/2000 | Chilewich et al. | |
| 6,859,964 | B1 | 3/2005 | Arnott | |
| D510,400 | S | 10/2005 | Rockstad et al. | |
| D511,096 | S | 11/2005 | Demaggio | |
| D552,912 | S | 10/2007 | Boutin | |
| D553,893 | S | 10/2007 | Boutin | |
| D565,894 | S | 4/2008 | Pryor et al. | |
| D592,448 | S | 5/2009 | Goodman et al. | |
| D594,971 | S | 6/2009 | Senkpiel | |
| D602,299 | S | 10/2009 | Heroux | |
| D638,647 | S | 5/2011 | Heroux | |
| D645,686 | S | 9/2011 | Heroux | |
| D645,687 | S | 9/2011 | Heroux | |
| D645,688 | S | 9/2011 | Heroux | |
| D645,689 | S | 9/2011 | Heroux | |
| D645,690 | S | 9/2011 | Heroux | |
| D645,691 | S | 9/2011 | Heroux | |
| D645,692 | S | 9/2011 | Heroux | |
| D657,471 | S | 4/2012 | Chin et al. | |
| 8,225,441 | B2 | 7/2012 | Heroux et al. | |
| D665,153 | S | 8/2012 | Suiter | |
| D675,056 | S | 1/2013 | Goodman et al. | |
| D677,977 | S | 3/2013 | O'Connell et al. | |
| D679,073 | S | 4/2013 | Sherman | |
| D696,064 | S | 12/2013 | Hwang | |
| 8,777,477 | B2 * | 7/2014 | Jackson | A23G 9/08 206/522 |
| D748,376 | S | 2/2016 | Chukhadarian-Gharibian | |
| D751,859 | S | 3/2016 | Lion | |

OTHER PUBLICATIONS

Fruit and Bread Basket Liners: Announced Jul. 15, 2007. Available from Internet URL: https://www.etsy.com/listing/6487971/bread-basket-liner-centerpiece-bread.

Basket Liner, DesignsByDona on Etsy, Dec. 7, 2013.

Hot Rolls—Vintage Red Gingham Check Bread Basket Liner Cloth Handmade, Fabulous Textiles on Etsy, Feb. 22, 2014.

Vintage Shabby CottageEmbroidered Bread Basket Liner Floral, IronandLaceLiners on Etsy, Apr. 1, 2014.

2 Roll Basket Cloths and Wicket Basket, Screenporchvintage on Etsy, Jan. 7, 2014.

Scalloped Bread Basket Liner, Celerie & South.

Ruby Lane Vintage Linens_Archived Sep. 12, 2015 [online], site visited [May 17, 2016]. Available from Internet URL:http://web.archive.org/web*.https://rubylane.com/item/200934-RL-62132/Vintage-Linen-Madiera-Embroidery-Hot-Rolls.

* cited by examiner

CONFORMABLE PLIABLE PRODUCE STORAGE INSERT

BACKGROUND OF THE INVENTION

The invention relates to a container for holding and storing products. More specifically, the invention relates to a liner for placement within the container, the liner to function as an interface between a container surface and the products stored in the container.

Produce, such as fruits and vegetables, are harvested and handled routinely from orchards and fields as part of their processing for wholesale and consumer purchase. When storing and transporting produce, such as harvested fruits and vegetables, it is desirable to minimize harsh impact on the produce surfaces and minimize moisture surrounding the produce to avoid bruising, enhance freshness, and maintain the pleasant appearance of the produce. This is especially important when handling relatively fragile fruits and vegetables such as peaches, pears, strawberries, tomatoes, mushrooms, and the like.

Store-purchased produce usually are transitioning away from commercial handling and processing techniques used on farms such as crating. At this point, the produce are handled on a smaller scale and thus, become vulnerable to harsh physical impact by retail stores and consumers. Produce that require open ambient conditions to ripen, for example, are often transported and stored in open baskets and containers. Such open containers often have a substantially rigid construction, thereby exposing the produce to harsh surface impact. Furthermore, despite being perforated, baskets still engage the exterior surface of the produce with a roughened and textured interior surface of the basket, e.g., weave pattern. Although some air flow among the produce articles in the container is permitted, the produce generally experience damage. Since typical container materials, such as baskets, and the like are usually non-absorbent, prolonged exposure to undesirable moisture can formulate irreparable mold and rotting.

There is a need in the field of produce harvesting, storage, and transport for a device and/or technique that can reduce impact and moisture of produce articles when retained in open containers such as baskets. There is a further need for an intervening surface buffer intercalated between the interior surface of a substantially rigid container and the contained produce therein which can prolong the freshness and desirable appearance of the produce over time.

SUMMARY OF THE INVENTION

The invention provides a conformable pliable produce storage insert device configured for placement within a basket. The insert device comprises an overall planar and circular configuration defining a planar circular central base having a circumscribing arcuate edge in continuity thereby defining the circular central base; and a plurality of separate planar extensions radially extending distally relative to the planar circular central base in adjacent circumscribing series thereto. Each of the extensions has a pair of arcuate side edges, a proximal edge and distal edge, and each extension is independently attached to a corresponding arcuate edge portion of the planar circular central base. The proximal edge of each extension is flexibly attached to a corresponding arcuate edge portion of the circular central base through a flexible hinge panel, whereby at least a portion of each arcuate side edge of the extension is structured to overlap the arcuate side edge of an adjacent extension.

Another aspect of the invention includes a produce storage system comprising: a basket; and a conformable pliable produce storage insert device configured for placement within the basket. The insert device comprises: an overall planar and circular configuration defining a planar circular central base having circumscribing arcuate edge in continuity thereby defining the circular central base; a plurality of separate planar extensions radially extending distally relative to planar circular central base in adjacent circumscribing series thereto, each of the extensions having a pair of arcuate side edges, a proximal edge and a distal edge. Each one of the planar extensions is independently attached to a corresponding arcuate edge portion of the planar circular central base. The proximal edge of each of the extensions is flexibly attached to a corresponding arcuate edge portion of the circular central base through a flexible hinge panel, whereby at least a portion of each arcuate side edge of the extension is structured to overlap the arcuate side edge of an adjacent extension.

Yet another aspect of the invention includes a method for storing and transporting produce comprising: assembling a basket and a conformable pliable produce storage insert device such that the insert device is placed inside the basket; placing at least one produce article within a conformable pliable produce storage insert device, the insert device conformably positioned within the interior of a basket. The insert device comprises: an overall planar and circular configuration defining a planar circular central base having a circumscribing arcuate edge in continuity thereby defining the circular central base; and a plurality of separate planar extensions radially extending distally relative to planar circular central base in adjacent circumscribing series thereto. Each of the planar extensions has a pair of arcuate side edges, a proximal edge and a distal edge; and wherein each one of the extensions is independently attached to a corresponding arcuate edge portion of the planar circular central base. The proximal edge of each of extension is flexibly attached to a corresponding arcuate edge portion of the circular central base through a flexible hinge panel; and whereby at least a portion of each arcuate side edge of the extension is structured to overlap the arcuate side edge of an adjacent extension.

The advantages associated with the invention include a pliable, cushioning basket insert which can readily conform to the interior surface of a basket without substantial pleating, folding, crimping, contorting, or hanging over the side of the basket. The insert device of the invention easily adapts from a resting flattened configuration into a hemispheric bowl configuration to mimic the interior configuration of a basket within which it is placed. In addition to adapting configuration, the construction and function of the insert device enhances the preservation of desirable produce condition by reducing surface impact/bruising, facilitating air movement among the produce articles in the basket, and reducing resident surface moisture to inhibit mold growth on produce article surfaces. These and other benefits and advantages will be apparent from the following description.

BRIEF DESCRIPTION OF THE DRAWINGS

The invention is further illustrated by the following figures with numerical references remaining consistent throughout. None of the specific embodiments illustrated are intended to be construed as necessarily limiting the claimed invention to such specifically depicted embodiment.

DETAILED DESCRIPTION OF THE INVENTION

Figure 1:
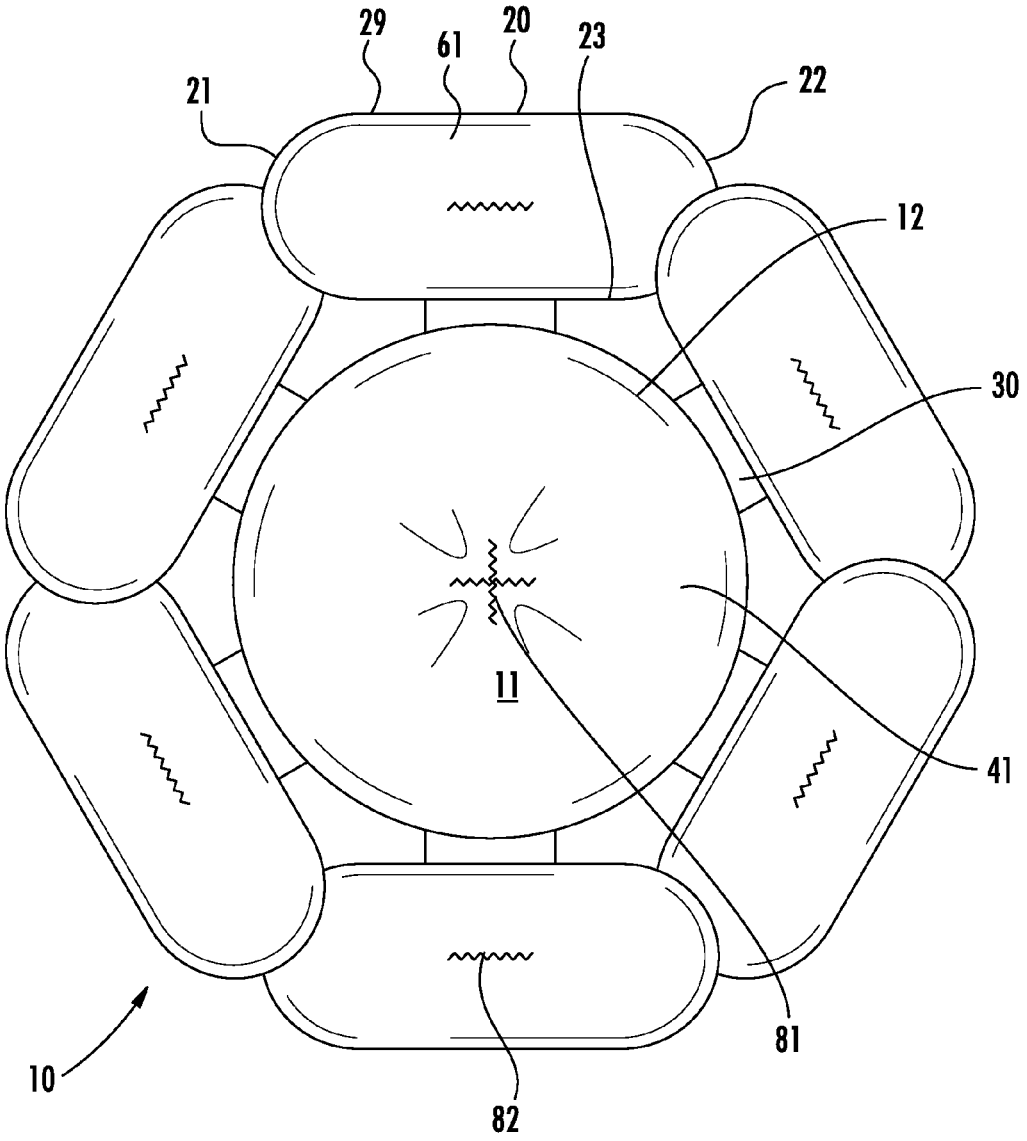
FIG. 1 is a top view of the insert device in a flattened state in accordance with one embodiment of the invention.

As used herein, the term "produce" is meant to refer to harvested or collected organic or fragile articles made by natural processes, including but not limited to, fruits, vegetables, eggs, and cut flowers. The term "produce article" is meant to refer to an item of produce, and "produce articles" is meant to refer to the same in plural.

As used herein, the term "basket" is meant to define a rigid or semi-rigid partially perforated or fenestrated receptacle open at the upper portion wherein the diameter or circumference of the edge of the upper portion is greater than the diameter or circumference of the remaining portions toward the lower base and having an overall cup, hemispheric, or bowl configuration. The circumference of the upper portion, base, or both, can be circular, oval, or elliptical. The rigid or semi-rigid basket material can be composed of various materials. Suitable rigid or semi-rigid natural materials include, but are not limited to, wood, grass, straw, cardboard, cellulosic compositions, and the like. Suitable rigid or semi-rigid metallic materials can be composed of metals and metallic alloys, including but not limited to, aluminum, stainless steel, copper, and the like. Suitable rigid or semi-rigid plastic and resin materials, glass, and ceramic compositions can also be used as the basket material. Perforations or fenestrations which permit ingress and egress of fluid flow through the basket wall can be formed as a result of gaps through woven structures, lattice structures, discrete apertures, and the like. The term is meant to encompass woven and non-woven baskets, colanders, sieves, cages, and the like, which permit some degree of air flow across the wall of the container.

The phrase "configured for placement within a basket" when used to refer to the insert device of the invention, is meant to indicate that the overall size, shape, and dimensions (e.g., height, width, length, diameter, circumference, perimeter) of the insert device generally conform to the interior surface dimensions and configuration of a basket within which the device is to be placed.

The term "circular" when used within the context of the configuration of the central base of the device of the invention is not intended to be limited to a perfect circle having a consistent radius at all points from a central point within the circle to all points along the circumference. The term "circular" is meant to include oval and elliptical configurations, for example.

The term "planar" as used herein to define the circular central base and extensions of the device of the invention is meant to refer to a substantially flattened pillow configuration and is meant to include variations in the thickness of the base and extensions as would be typically associated with the presence of an internal filling material between opposing fabric panels. The term is not meant to refer to a perfectly flat configuration of consistent thickness.

The terms "proximal" and "distal" and inflections thereof when used to describe a relationship of components to one another within the context of the invention, unless otherwise specified in relation to a particular component, are referred to relative to the center point of the planar circular central base. For instance, an object extending radially and distally from the planar circular central base would be located in an outward linear direction along an outer circumference relative to a point and circumference positioned inward, closer toward the center of the planar circular central base.

The invention provides a conformable pliable produce storage insert device configured for placement within a basket. Referring now to FIG. 1, in one embodiment, the insert device (10) comprises an overall planar and circular configuration defining a planar circular central base (11) having a circumscribing arcuate edge (12) in continuity thereby defining the circular central base. Radiating from the planar circular central base (10) are a plurality of separate planar extensions (20), radially extending distally relative to the planar circular central base (11) in adjacent circumscribing series thereto. Each of the planar extensions (20) has a pair of oppositely disposed arcuate sides (21) and (22), a proximal edge (23) and distal edge (29). Each one of the planar extensions (20) is independently attached to a corresponding arcuate edge portion (12) of the planar circular central base (11). The arcuate edge portions (12) have intermittently attached planar extensions (20) at varying locations along the circumscribing arcuate edge (12) of the circular central base (10).

The number of planar extensions (20) can vary. Preferably, the number of planar extensions (20) can range from five to seven and are substantially evenly distributed along the circumscribing edge of the planar circular central base (11). The functional and operational benefits afforded by the structure of the insert device can be achieved by as few as five planar extensions (20). The number of planar extensions (20) used in the device can increase in order to achieve the continuous overlapping functionality of the planar extensions as necessary according to the dimensions and configuration of the planar extension (20). For instance, in the case with narrower planar extension shapes, e.g., where the length of the planar extension extends distally and radially away from the central base panel and this length is greater than the width of the planar extension, the number of planar extensions can range from between about eight to about twelve. Examples of planar extension configurations and shapes where this would be the case include, but are not limited to, shields, petals, chevrons or tongue-shaped planar extension shapes.

One of the advantages afforded by the invention is that, by virtue of the structural configuration and overlapping functionality of the planar extensions, the sequential overlapping arrangement of the planar extensions (20) collectively in series form a contiguous circumscribing perimeter surrounding the interior sidewall of the basket adjacent to the upper edge of the basket opening. Additionally, this arrangement can conform to varying structural configurations and sizes of the basket within which it can be inserted.

Figure 3:
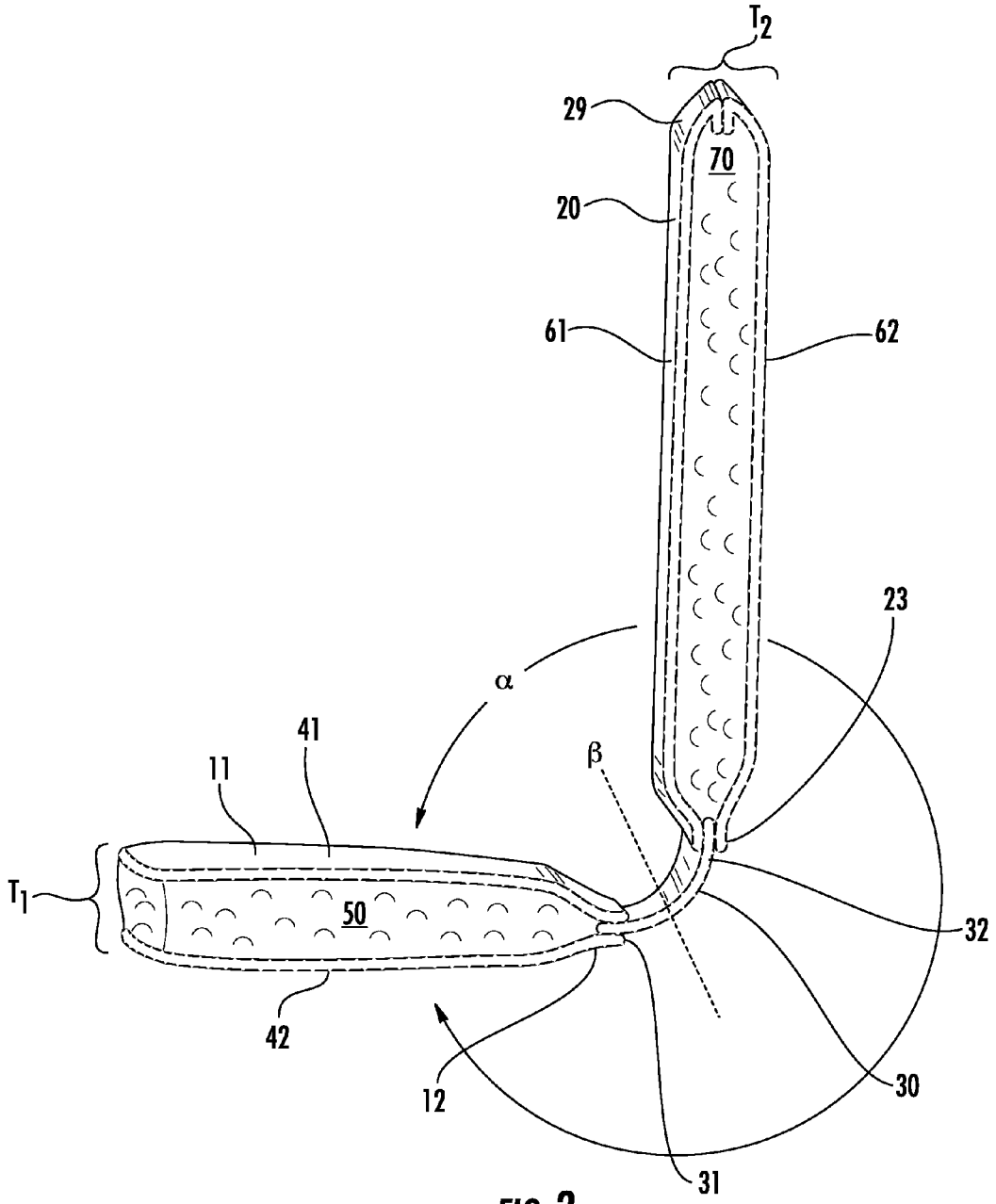
FIG. 3 is a cut-away angled side view of a portion of the planar circular central base, flexible hinge panel, and planar extension attached thereto according to one embodiment of the invention.
Figure 4:
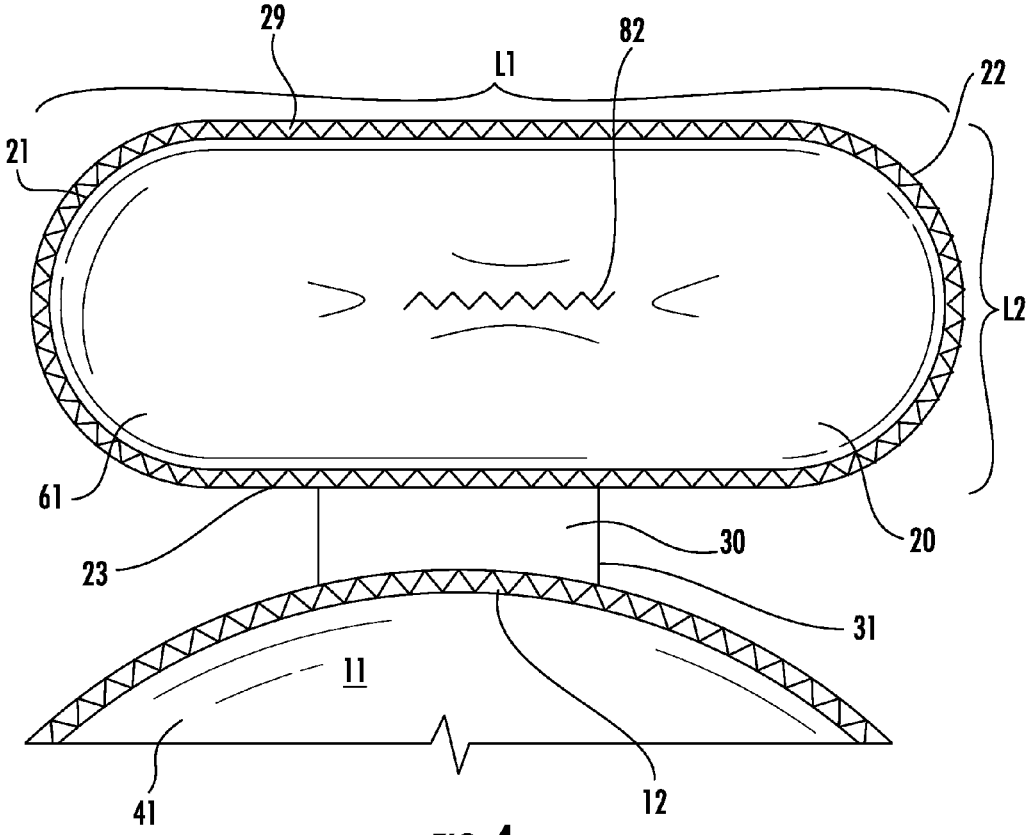
FIG. 4 is a top view of a section of arcuate edge portion of a planar circular central base connected by flexible hinge panel to a proximal portion of a planar extension according to one embodiment of the invention.
Figure 5:
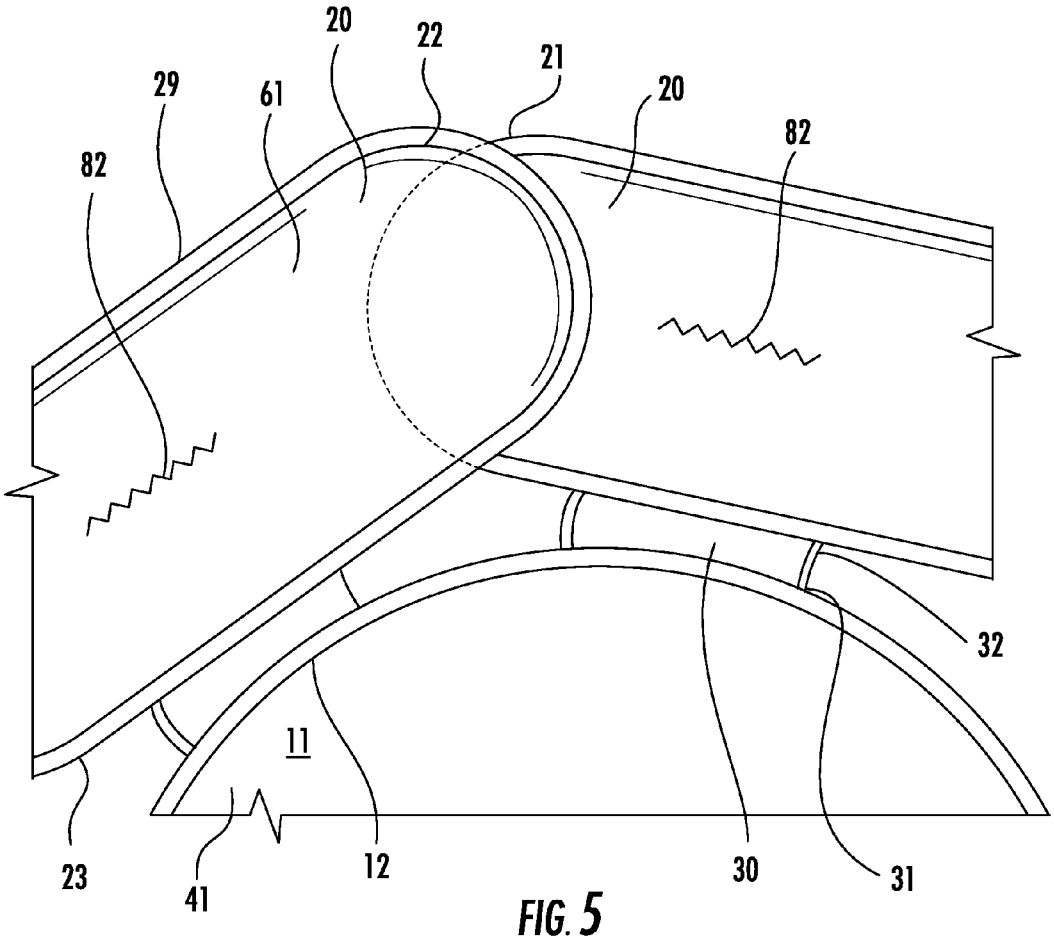
FIG. 5 is a top view of a section of two adjacent straight edge portions of a planar circular central base each respectively connected to an adjacent pair of planar extensions showing overlapped arcuate side edges of the extension according to one embodiment of the invention.

As seen in FIGS. 1, 4, and 5, for example, the length of the proximal edge (23) of the planar extension (20) is generally parallel to the corresponding edge portion (12) of the circular central base (11) to which it is attached. The proximal edge (23) of each planar extension (20) is flexibly attached to a corresponding edge portion (12) of the planar circular central base (11) through a flexible hinge panel (30) as shown in FIG. 3. The flexible hinge panel (30) permits free movement along a general latitudinal running axis β along the width of the flexible hinge panel (30) so as to permit free rotational motion thereabout (shown as axis α) between the planar extension (20) relative to the planar circular central base (11).

Referring now to FIG. 4, preferably the proximal edge (23) of each planar extension (20) runs generally parallel to the corresponding arcuate edge portion (12) of the circular central base (11) to which it is attached. By virtue of the collective construction and dimensions of the insert device (10) of the invention, at least a portion of each of the arcuate side edges, (21) and (22), of the planar extension (20), is structured to overlap and extend beyond the side edge (21) of an adjacent planar extension (20) in series, as shown in FIG. 5, and collectively illustrated in FIG. 1, for example. As assembled, the flexible hinge panels (30) are mechanically discrete relative to adjacent planar extensions (20), in that the planar extensions (20) are not attached other than through flexible hinge panel (30) to the arcuate edge portion (12) of the planar circular central base (11). The hinged extensions (20) detachably interact in sequence to permit a continuous overlapping arrangement with adjacent planar extensions (20) surrounding the entire perimeter or circumference of the planar circular central base (11). In a preferred embodiment and as seen in the figures, the arcuate edge portion (12), overlapping planar extensions (20) and the flexible hinge panels (30) collectively form a space between each of the flexible hinge panels (30) so as to permit ingress and egress of air flow there through.

The configuration or shape of the planar extensions (20) can vary, provided the proximal edge (23) and first and second arcuate side edges (21) and (22), respectively, adjacent to the attachment site of the flexible hinge panel (30) are present and the shape and the functional sequential overlapping position between planar extensions (20) as described is maintained. In the Figures, the planar extension(s) (20) are depicted as a generally elongated elliptical shape with arcuate side edges rounded to resemble a "capsule." Additional planar extension shapes that can be used include, but are not limited to, circles, ovals, rounded rectangles, rounded squares, shields, petals, chevrons or tongue-shaped planar extension shapes, and the like. Although depicted in the figures as being the same, alternating, or otherwise differing planar extension shapes can be used, provided the desired positional sequential overlapping occurs along the entire perimeter of the planar circular central base (11).

Referring now to FIG. 4, a preferred embodiment of the insert device of the invention (partial view) is depicted wherein the planar extension (20) comprises a structure whereby the length L1 of the planar extension between the oppositely disposed arcuate edges (21) and (22) is greater than the length L2 of the planar extension (20) between the proximal edge (23) and the distal edge (29) of the planar extension (20). Length L1 can vary relative to length L2, the total number of flexible planar extensions (20), and overall configuration of the insert device (10) in order to achieve the desired resultant overlapping arrangement of the flexible panel extensions (20) over one another along the outer circumference of the insert device (10) as described herein. In general, the ratio of length L2 to length L1 can range from between 1:1 to about 7:1. Although depicted as a "capsule" shape formed from a pair of oppositely disposed arcuate side edges (21) and (22) and straight proximal edge (23) and straight distal edge (29), all edges of the flexible panel extension (20) can be arcuate or curvilinear, and one or both of the proximal edge (23) and distal edge (29) can be arced inward toward the center of the panel extension (20) or arced outward.

Figure 6:
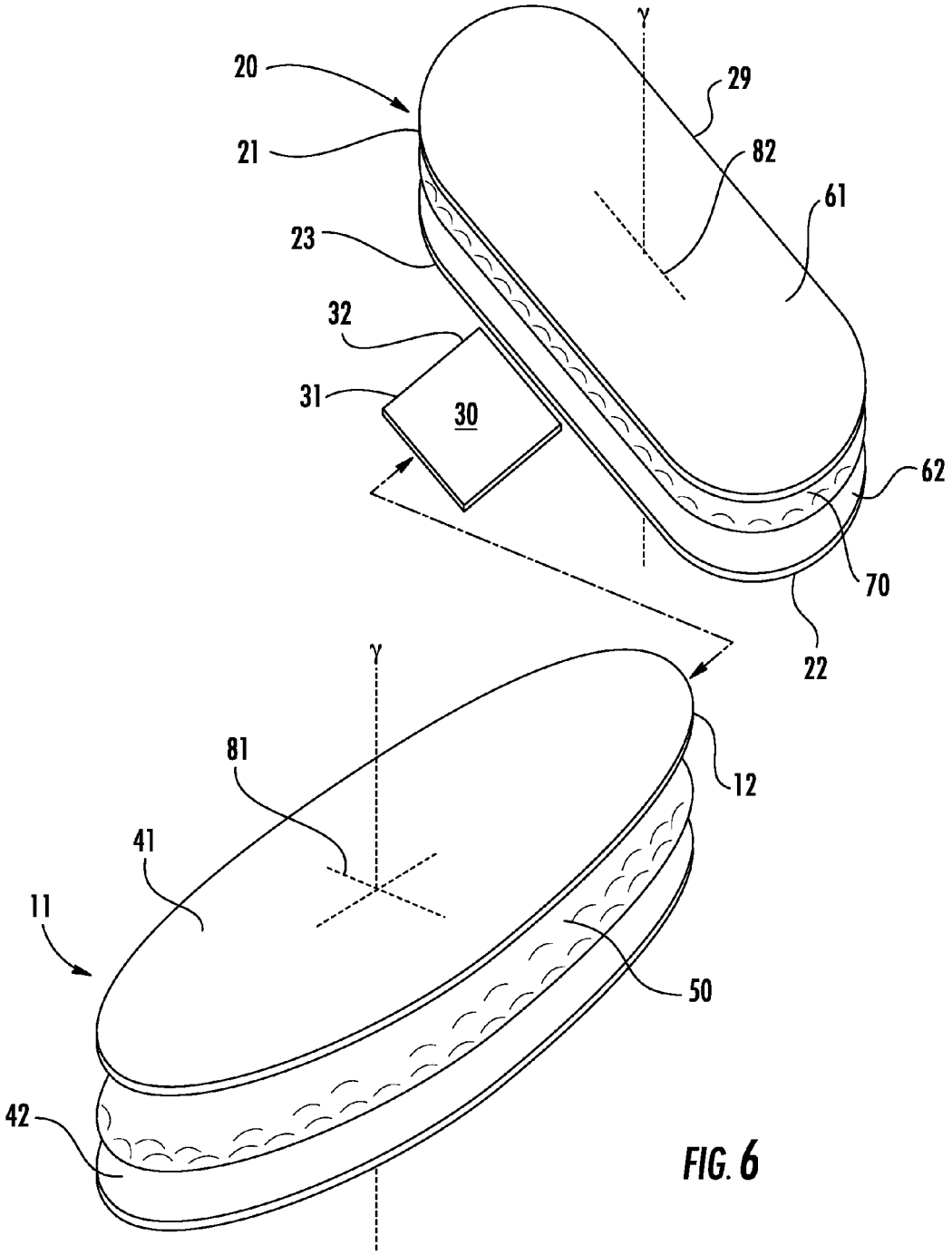
FIG. 6 is an exploded view from an angled side perspective showing the separated components of the planar circular central base and a single planar extension and interposed flexible hinge panel according to one embodiment of the invention.

Referring to FIG. 3 and FIG. 6, the planar circular central base (11) of the insert device (10) of the invention comprises a pair of first and second oppositely disposed fabric panels, (41) and (42), respectively, having a layer of pliable filling material (50) between and contained therein. The oppositely disposed fabric panels (41) and (42) are continuously attached to one another along the entire length of their respective perimeters. Likewise, each of the separate planar extensions (20) comprises a pair of first and second oppositely disposed fabric panels, (61) and (62), respectively, having a layer of pliable filling material (70) between and contained therein. The oppositely disposed fabric panels (61) and (62) are continuously attached to one another along the entire length of their respective perimeters.

The thickness (T1) of the planar circular central base (11) and thickness (T2) of the planar extensions (20) (see FIG. 3, for example) can be varied in accordance with the invention. The thickness and pliable properties of these components and overall insert device (10) of the invention can be adjusted as part of the manufacturing process by increasing or decreasing the amount of pliable filler material used. It is important when varying thickness, however, that the overall configuration of the device maintains a substantially planar configuration and it does not part from the functionality of the invention.

In a preferred embodiment, and as shown in FIGS. 1, 2, 5, and 6, the first and second oppositely disposed fabric panels (41) and (42) of the planar circular central base (11) and the first and second oppositely disposed fabric panels (61) and (62) of each of the planar extensions (20) can be fixed through the interior along a transverse axis γ (see FIG. 6) through panel attachments. In one embodiment and as shown in the Figures, the planar circular central base panel attachment (81) and planar extension panel attachment (82) are positioned in the approximate central area of the component panels and configured as discrete attachments. The panel attachments (81) and (82) function to inhibit the interior migration of the filling material and maintain more uniform distribution of the filling material within. The panel attachments (81) and (82) can be formed using a threaded sewn stitch (as illustrated), stud, rivet, adhered to, or otherwise fastened to fixedly secure the opposing panel. The panel attachments (81) and (82) can perforate the filling material or directly attach the interior of each opposing panel.

Various panel attachment techniques and structures can be employed. A combination of two embodiments of panel attachments are illustrated in the Figures. Referring now to FIG. 1, a cross-shaped centrally located stitch as panel attachment (81) can be located in the center of the planar circular central base (11) component, and a linear stitch panel attachment (82) can be located in the central area of each planar extension (20). In an alternative embodiment, various configurations to attach the fabric panels can be used, including but not limited to, multiple discrete attachments, contiguous quilt stitching, and the like. Preferably, single discrete centrally located fabric attachments are used with the invention so as to optimize the pliability properties afforded by the internal filling material.

Figure 2:
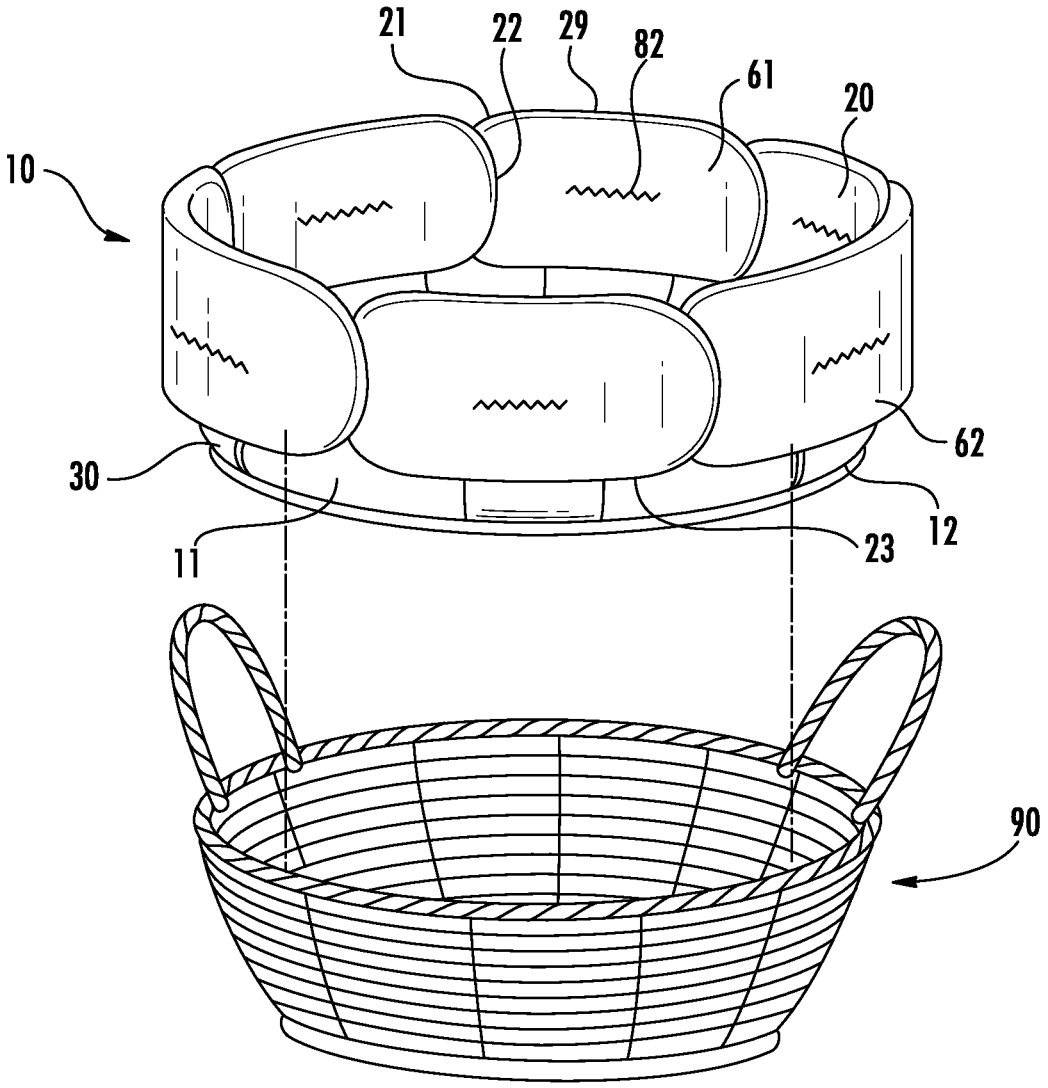
FIG. 2 is a schematic illustration from an angled side view of the insert device in conforming state to a basket and as separated from a basket according to one embodiment of the invention.

The arcuate edge portions (12) of the planar circular central base (11) and the proximal edge (23) of the planar extensions (20) are attached to one another indirectly through a flexible hinge panel (30). Specifically, the flexible hinge panels (30) function to permit easy motion of the individual planar extensions (20) relative to the planar circular central base (11) in order to facilitate ready conformation of the insert device (10) into a basket (90) (as illustrated in FIG. 2, for example). The flexible hinge panel (30) is preferably a simple construction from a single or double layer of flexible material without the presence of filling material therein. The width and length of the flexible hinge panel (30), and the resulting connective distance between the arcuate edge portion (12) of the planar circular central base (11) and the planar extension (20) can vary, provided the desired sequential overlapping arrangement of the first and second oppositely disposed arcuate edges (21) and (22) of the planar extensions (20) do not part from the functionality and operation of the invention. Preferably, the hinged distance between the edge portion (12) of the planar circular central base (11) and proximal edge (23) of the corresponding planar extension (20) is relatively minimal so as not to create substantial gaps between the insert device (10) and the interior surface of the basket (90).

In addition to the thicknesses (T1) and (T2) of the insert device (10) components, the overall dimensions of the insert device (10) can be varied according to the contemplated or desired basket (90) within which it is to be placed. Insert device (10) dimensions such as overall diameter, planar extensions (20), planar circular central base panel (11) diameter, planar extension (20) length and width, and the like—can all be modified as part of the manufacturing process in this manner. Furthermore, although the insert device (10) of the invention is described and depicted as having an overall substantially symmetrical construction and configuration, the insert device can be constructed as an asymmetrical configuration as well provided the functional and operational benefits and advantages associated with the invention are not substantially attenuated or compromised. For example, the circular central base panel (11) and overall configuration of the insert device can be oval or elliptical to conform to an oval or an elliptical shape basket.

The overall dimensions of the insert device (10) of the invention can be determined according to the dimensions and shape of the intended basket (90) into which it may be received, and the insert device (10) can be manufactured accordingly. For instance, the general diameter of the planar circular central base (11) would correspond to the central receiving portion of the basket (90), (see FIG. 2, for example), i.e., the diameter of the basket interior bottom. An important functional aspect of the invention is that the insert device (10) is structured to readily and substantially adapt and conform to the interior dimensions of the basket (90). The insert device (10) of the invention can readily change from a flattened, horizontal state (see FIG. 1, for example) into a conforming variable hemispheric or "bowl-like" state (as shown in FIG. 2, for example). Another important functional aspect of the invention is that during and at the conforming state, the paneled components of the insert device ((41) and (42) of the planar circular central base (11), and (61), and (62) of planar extension (20)), aside from the flexible hinge panel (30), are absent resulting and undesirable crimping, pleating, or folding of their interior and exterior surfaces as might occur with a traditional single contiguous fabric panel basket liner structure.

Materials:

First and second oppositely disposed fabric panels, (41) and (42) respectively, of the planar circular central base (11), first and second opposing fabric panels, (61) and (62) respectively, of the planar extension (20), and the flexible hinge panel (30), can be composed of flexible woven or non-woven fabric material. Suitable fabric material that can be used for these components of the insert device (10) preferably include, but are not limited to, fabrics that are flexible, breathable or porous, wick moisture, soft, washable, and reusable. Suitable fabrics include, but are not limited to, natural woven cotton, bamboo, cotton-synthetic blends such as 80% cotton 20% polyester, and the like. Different components of the insert device (10) can be composed of the same or different fabrics having different properties.

Suitable filling materials that can be used in the planar circular central base (11) and planar extensions (20) of the insert device (10) include, but are not limited to, pliable natural and synthetic materials that permit some degree of air movement and circulation. Suitable pliable natural materials can include non-woven cotton, cotton, bamboo, sponge, and excelsior. Suitable synthetic filling materials include, but is not limited to, polyester fiberfill, such as POLY-FIL® polyester fiberfill (available from Fairfield Processing Corporation, Danbury, Conn.); and polyurethane foam materials, such as POLY FOAM™ (available from American Excelsior Company, Arlington, Tex.). In one embodiment, a preferred filling material for ideal functionality is polyurethane foam. In a further embodiment, different filling materials may be used in different components of the insert device. It is an important aspect of the invention that whichever filling material is selected, that it possess a pliable, soft, cushion and breathable property in order to fully realize the benefits afforded by the invention.

How to Make

The insert device (10) of the invention can be made using conventional and readily available materials, techniques, and equipment to those in the textile manufacturing and construction fields, such as sewing machinery. In one example, and referring now to FIG. 6, the first and second oppositely disposed fabric panels (41) and (42) of the planar circular central base (11), with a layer of filling material (50) positioned between, can be attached along the entire length of the perimeter formed by the contiguous circumscribing edge portions (12). Similarly, each of the first and second oppositely disposed fabric panels (61) and (62) of the planar extensions (20) can be attached along the perimeter including first and second oppositely disposed arcuate edges (21), (22) and proximal edge (23), so as to contain a layer of filling material (70) within. The proximal end (31) (see FIGS. 3, 4, 5 and 6, for example) of the flexible hinge panel (30) can be integrally secured to the edge portions (12) of the planar circular central base (11), and the distal end (32) of the flexible hinge panel (30) can be integrally secured to the proximal edge (23) of each planar extension (20). The securing of the flexible hinge panel (30) can be accomplished either as part of the attachments of the first and second oppositely disposed fabric panels of each of the planar circular central base (11) and planar extensions (12), or alternatively, secured following the attachment of the perimeters of the first and second oppositely disposed fabric panels. The attachment of the flexible hinge panel (30) and planar extensions (20) to the planar circular central base (11) are repeated for each flexible hinge panel (30) and planar extensions (20) pairing to be constructed for the insert device (10). The layers of filling material (50) and (70) can be secured into position upon final assembly by applying threaded stitching through the central area of the assembled fabric panels of the planar circular central base (11) and planar extensions (20) along transverse axis γ (see FIG. 6).

Attachments of the planar extensions (20) to the planar circular central base (11) may be accomplished using conventional fabric attaching materials and techniques, including but not limited to, stitching using thread, adhesive, riveting, and the like. The fabric panels may be attached continuously and circumscribing along the entire length of the perimeters of each planar extension (20) and planar circular central base (11). Preferably, whichever technique is employed, the flexibility along the seams should not be substantially compromised or attenuated. Accordingly, in one embodiment, threaded stitching is most preferred.

How to Use

The invention may include a produce, method, and system for storing and transporting produce comprising a basket, and a conformable produce storage insert device configured for placement within the basket. According to one method for storing and transporting produce, a basket and a conformable pliable produce storage insert device can be assembled such that the insert device is initially placed inside a basket, at least one produce article may be received by a conformable pliable produce storage insert device, with the insert device conformably positioned within the interior surface of a basket. Referring to FIG. 2, the insert device (10) of the invention can be inserted into a basket (90) and conforms to the interior configuration of the basket (90) such that the exterior surfaces of the insert device (10) contact the interior surface of the basket (90). Produce articles, such as fruit and vegetables (not shown), can then be placed into the exposed open surface of the insert device (10). The collective structural features and configuration of the insert device (10) can permit some degree of air movement and circulation surrounding the produce articles, and provide a soft pliable moisture absorbent contacting surface within the basket to sustain freshness of the produce items. Accordingly, the invention mitigates irreparable mold, rotting, spoilage, and bruising of produce items and enhances storage longevity.

Figure 7:
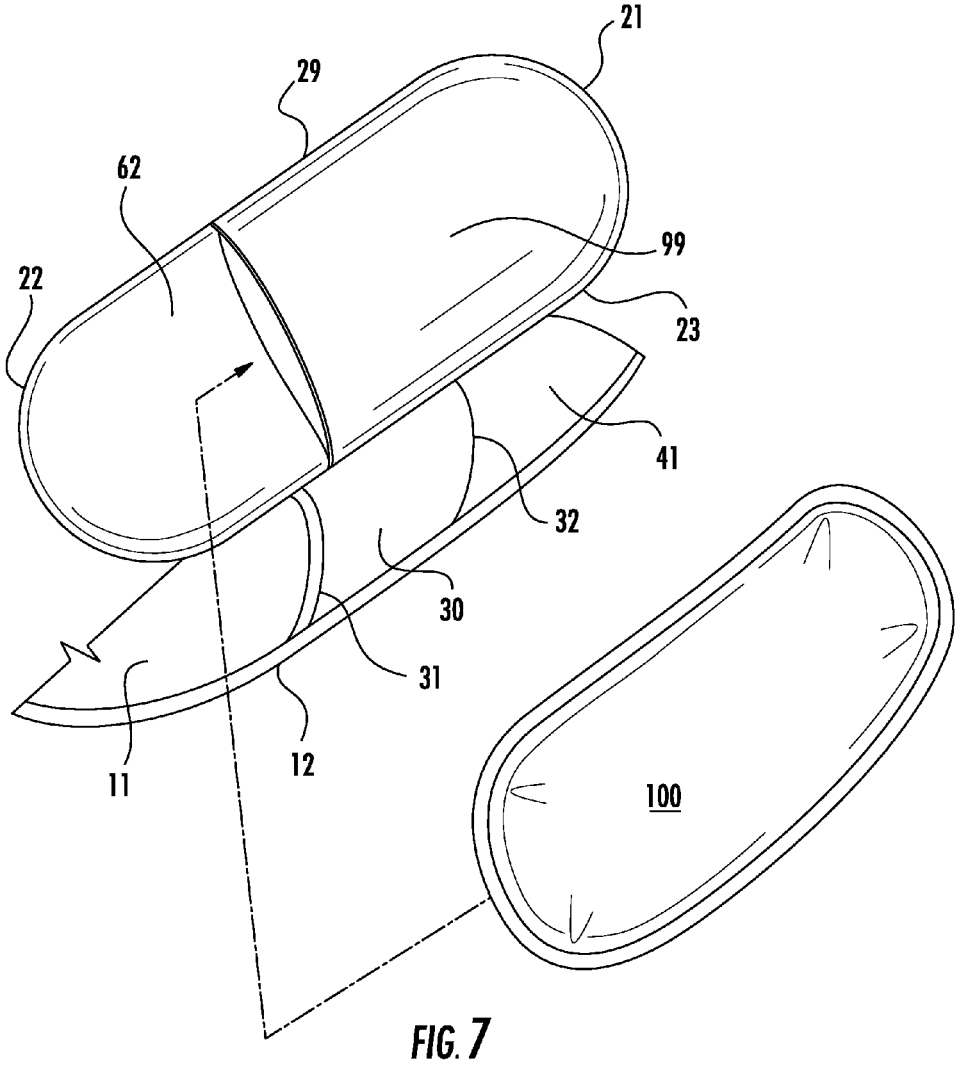
FIG. 7 is a separated view of an individual planar extension attached to a arcuate edge portion of planar circular central base, the extension having a pocket to receive a separate thermal pack according to one embodiment of the invention.

In an additional embodiment of the invention as depicted in FIG. 7, the preservation characteristics associated with the insert device (10) of the invention can be further enhanced by a planar extension (20) further comprising a pouch (99) structured and dimensioned to receive a thermal pack (100) therein. The phrase "structured and dimensioned to receive a thermal pack therein" is meant to define the construction of a pouch having interior dimension, (e.g., height, width, depth) that corresponds to a thermal pack, selected and constructed having exterior dimensions (e.g., height, width, depth), so as to be received within the planar extension pouch. See FIG. 7, for example. The pouch (99) can be located on either the interior surface or the exterior surface (as shown) of the planar extension (20). Suitable pouches can be constructed as a simple open pocket (as shown), or alternatively, can be structured as a closeable pocket, buttoned pocket, snap pocket, Velcro® (available from Velcro USA, Inc., Manchester, N.H.) reversibly sealable pocket, zippered pocket, overlapping folds of fabric, and the like. Pouches can be present on few planar extensions, all of the planar extensions, or alternating planar extensions of the insert device (10).

Figure 8:
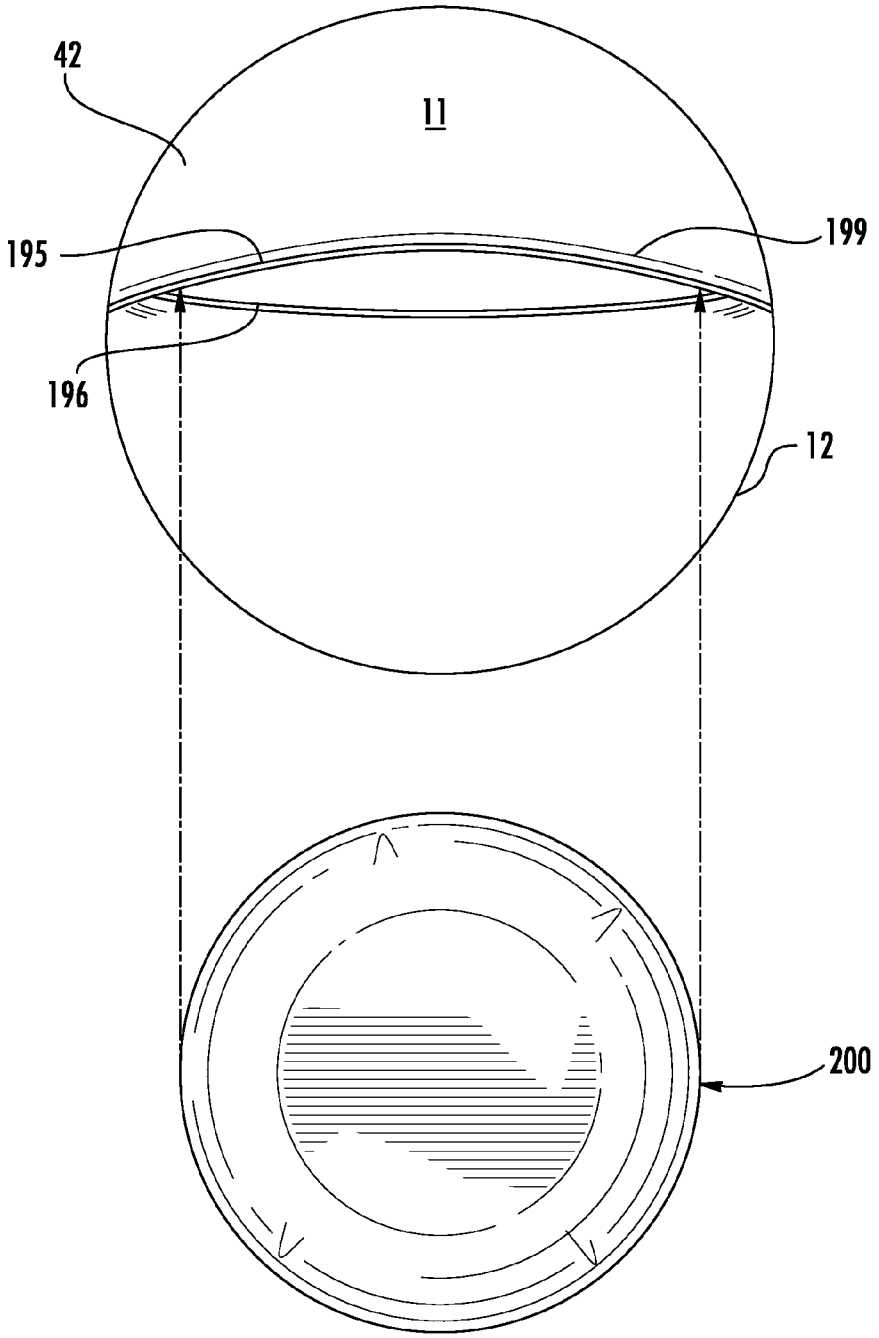
FIG. 8 is a planar view of the bottom surface fabric panel of the planar circular central base component of the insert device showing a pouch structured to receive a thermal pack, and a corresponding thermal pack, according to one embodiment of the invention.

In yet another embodiment of the invention as depicted in FIG. 8, the circular central base (11) component (shown by itself in separated state) of the insert device of the invention can further comprise a pouch (199) on the bottom surface fabric panel (42) wherein the pouch (199) is structured and dimensioned to receive a thermal pack (200) therein. Similarly as with the planar extension pouch described herein above, The phrase "structured and dimensioned to receive a thermal pack therein" is meant to define the construction of a pouch having interior dimension, (e.g., height, width, depth) that corresponds to a thermal pack, selected and constructed having exterior dimensions (e.g., height, width, depth), so as to be received within the circular central base pouch (199). Although the thermal pack (200) for the circular central base (11) is depicted as having a circular configuration, a variety of shapes are possible e.g., a corresponding circular configuration to the specific circular central base (11) into which the thermal pack (200) can be placed.

For purposes of accessibility and convenience, the pouch (199) is preferably located on the bottom of the circular central base (11). It is possible, nevertheless, for the upper interior surface of the circular central base s11) to comprise a pouch structure. Again as with the planar extension pouch embodiment, suitable pouches can be constructed as a simple open pocket (as shown), or alternatively, can be structured as a closeable pocket, buttoned pocket, snap pocket, Velcro® reversibly sealable pocket, zippered pocket, overlapping folds of fabric (as illustrated in FIG. 8), and the like.

Various combinations of the embodiments comprising the thermal pack can be used in the invention. For instance, the planar extension(s) alone, the circular central base alone, or a combination of both planar extension(s) and circular central base can comprise one or more thermal packs therein. Furthermore, combinations of different pouch structures and configurations can be employed within a single insert device of the invention. Preferred pouch structure(s) for the planar extension pouch embodiment, circular central base pouch embodiment, or both, can be a pouch wherein the opening through which the thermal pack can be inserted through is formed as an overlapping fold of two portions of the fabric panel. One example of this overlapping fold pouch structure is illustrated in FIG. 8, whereby the thermal pack can be inserted under the outer fold (195) and subsequently tucked under the inner fold (196) to secure the thermal pack (200) within the circular central base (11) of the insert device. A similar pouch structure as described can also be used for the planar extension thermal pack embodiment.

Suitable thermal packs in either of these described embodiments that may be used, but is not limited to, include thermal freezer packs, readily available reusable sealed plastic bags, containers containing a freezable liquid or gel for freezing or refrigeration, re-fillable or re-sealable ice bags, as well as single-use endothermic reactive chemical compositions. A variety of suitable thermal cold packs which are readily available to those in the art can be employed in combination with the invention. Suitable thermal cold packs that can be used in the invention include, but is not limited to, cold packs that contain an insulating material which, upon cooling in a refrigerator or freezer, gradually warm back to ambient temperature, cold packs that operate via a change of phase of the components of the cold pack, and cold packs that employ chemical components that dissolve endothermically in a solvent.

Examples of thermal cold packs that employ an insulating material are cold packs that contain a coolable or freezable liquid, e.g., water, or a gel. In one embodiment, these cold packs are cooled in a refrigerator or freezer. Typical gels are based on the gelation of xanthan gum, locust bean gum, gum tragacanth, guar gum, hydroxypropyl methylcellulose, absorbent polymers, and the like. Gels may also be based on a high molecular weight polyacrylic acid cross-linked with a polyalkenyl ether, also referred to as a cis-carbomer.

Thermal cold packs using phase change materials may be converted between solid and liquid phases and utilize their latent heat of fusion to cool during such phase conversion. The latent heat of fusion is greater than the sensible heat capacities of the materials. Accordingly, the amount of energy absorbed upon melting or released upon freezing is greater than the amount of energy absorbed or released upon increasing or decreasing the temperature of the material by 10 degrees C. In one embodiment, water is used as a phase changing material.

Endothermic dissolution cold packs contain certain chemical compounds that, once dissolved into a solution, result in a lowering of the temperature of the solution below ambient temperature. On dissolution, these compounds take up heat from the surrounding environment. For example, inorganic salts or soluble organic compounds known to have a positive (greater than zero) enthalpy of aqueous solution are used to make the reduced temperature solutions useful in cold packs.

In an additional embodiment of the invention, the exterior surfaces of the fabric panels of the various components of the insert device of the invention can be colored and include any externally visible designs or illustrations thereon. Various conventional techniques can be used to apply designs, patterns, or colors to flexible fabrics, including but not limited to, stenciling, screen printing, dying, weaving, stitching, appliqués, and the like.

Although the full benefits and advantages afforded by the invention are manifested in the storage and handling of produce articles, additional uses are contemplated by the invention as well and its use is not limited to produce articles such as fruits and vegetables. For instance, baked bread items, such as rolls and doughnuts, can also be used in the invention.

The invention has been described herein with reference to specific and preferred embodiments and techniques. It will be understood by one of ordinary skill in the art to which the invention relates, however, that reasonable variations and modifications can be made of such embodiments and techniques without substantially departing from either the spirit or scope of the invention as defined by the following claims.

What is claimed is:

1. A produce storage insert device comprising:

a planar configuration defining a circular central base having a continuous arcuate edge circumscribing to thereby define the circular central base;

a plurality of separate planar extensions radially extending distally relative to the planar circular central base in adjacent circumscribing series thereto, each of the extensions having a pair of arcuate side edges, a proximal edge and a distal edge;

wherein each one of the extensions is independently attached to a corresponding arcuate edge portion of the planar circular central base;

wherein the proximal edge of each of the planar extension is flexibly attached to a corresponding arcuate edge portion of the circular central base through a flexible hinge panel; and whereby at least a portion of each arcuate side edge of the extension is structured to overlap the arcuate side edge of an adjacent extension.

2. The insert device according to claim 1, further comprising the planar circular central base having a pair of first and second oppositely disposed fabric panels, the panels having a layer of pliable filling material between and contained therein, the oppositely disposed fabric panels being continuously attached to one another along an entire length of their respective perimeters.

3. The insert device according to claim 1, further comprising each separate planar extension having a pair of first and second oppositely disposed fabric panels having a layer of pliable filling material between and contained therein, the oppositely disposed fabric panels being continuously attached to one another along an entire length of their respective perimeters.

4. The insert device according to claim 1, wherein the number of planar extensions is within a range from between five to about seven.

5. The insert device according to claim 2, further comprising the first and second oppositely disposed fabric panels of the planar circular central base having a centrally located fabric attachment.

6. The insert device according to claim 3, further comprising the first and second oppositely disposed fabric panels of the planar extensions having a centrally located fabric attachment.

7. The insert device according to claim 1, further comprising the planar extension of the insert device having a pouch structured and dimensioned to receive a thermal pack therein.

8. The insert device according to claim 1, wherein the circular central base edge portions, overlapping planar extensions and the flexible hinge panels collectively form a space between each of the flexible hinge panels so as to permit ingress and egress of air flow there through.

9. The insert device according to claim 1, further comprising the circular central base having a pouch structured and dimensioned to receive a thermal pack therein.

10. A storage system comprising:

a basket; and a conformable pliable produce storage insert device configured for placement within the basket, the insert device comprising:

an overall planar and circular configuration defining a planar circular central base having a continuous arcuate edge circumscribing to thereby define the circular central base;

a plurality of separate planar extensions radially extending distally relative to planar circular central base in adjacent circumscribing series thereto, each of the extension having a pair of arcuate side edges, a proximal edge and a distal edge;

wherein each one of the extensions is independently attached to a corresponding arcuate edge portion of the planar circular central base;

wherein the proximal edge of each extension is flexibly attached to a corresponding arcuate edge portion of the circular central base through a flexible hinge panel; and whereby at least a portion of each arcuate side edge of the extension is structured to overlap the arcuate side edge of an adjacent extension.

11. The storage system according to claim 10, further comprising the planar circular central base of the insert device having a pair of first and second oppositely disposed fabric panels having a layer of pliable filling material between and contained therein, the oppositely disposed fabric panels being continuously attached to one another along the entire length of their respective perimeters.

12. The storage system according to claim 10, further comprising each separate planar extension of the insert device having a pair of first and second oppositely disposed fabric panels having a layer of pliable filling material between and contained therein, the oppositely disposed fabric panels being continuously attached to one another along the entire length of their respective perimeters.

13. The storage system according to claim 10, wherein the number of planar extensions is within a range from between five to about seven.

14. The storage system according to claim 11, further comprising the first and second oppositely disposed fabric panels of the planar circular central base having a centrally located fabric attachment.

15. The storage system according to claim 12, further comprising the first and second oppositely disposed fabric panels of the planar extensions having a centrally located fabric attachment.

16. The storage system according to claim 10 further comprising the planar extension of the insert device having a pouch structured and dimensioned to receive a thermal pack therein.

17. The storage system according to claim 10, wherein the circular central base edge portions, overlapping planar extensions and flexible hinge panels of the insert device collectively form a space between each of the flexible hinge panels so as to permit ingress and egress of air flow there through.

18. The storage system according to claim 10, wherein the insert device further comprises a circular central base having a pouch structured and dimensioned to receive a thermal pack therein.

* * * * *